United States Patent [19]

Vogel, II

[11] Patent Number: 4,860,396

[45] Date of Patent: Aug. 29, 1989

[54] BACKBOARD FOR DUAL OCCUPANCY BED

[76] Inventor: Frank D. Vogel, II, 1108 36th St., Parkersburg, W. Va. 26104

[21] Appl. No.: 228,452

[22] Filed: Aug. 5, 1988

[51] Int. Cl.[4] ..... A47C 21/06

[52] U.S. Cl. ..... 5/446; 5/508

[58] Field of Search ..... 5/447, 446, 440, 462, 5/464, 468, 508, 513, 431

[56] References Cited

U.S. PATENT DOCUMENTS

| | | | |
|---|---|---|---|
| 2,861,278 | 11/1958 | Young | 5/446 |
| 3,059,249 | 10/1962 | Kamp | 5/464 |
| 3,125,768 | 3/1964 | Rickert | 5/446 |
| 3,769,643 | 11/1973 | Adler | 5/464 |
| 3,806,968 | 4/1974 | Robey | 5/446 |
| 4,649,583 | 3/1987 | Krueger | 5/446 X |

*Primary Examiner*—Gary L. Smith
*Assistant Examiner*—Michael J. Milano
*Attorney, Agent, or Firm*—Watson, Cole, Grindle & Watson

[57] ABSTRACT

A backboard for a dual occupancy bed that allows two sleepers to lie on a single mattress such that each sleeper may remain substantially undistributed by the other's presence on the mattress. The backboard includes two planar members spaced by a connector along their longitudinal axes.

7 Claims, 1 Drawing Sheet

BACKBOARD FOR DUAL OCCUPANCY BED

FIELD OF INVENTION

The present invention relates generally to bed structures and more specifically to backboards adapted for use with sleeping surfaces on which human beings recline.

BACKGROUND OF INVENTION

It is customary in the construction of beds to provide a substantially smooth, flat, even mattress surface on which the sleeper lies. It is also well known that a solid board, when placed directly beneath the mattress, helps to ensure such a smooth, flat, even surface.

A problem that has been encountered even when a backboard is used beneath a mattress is that a sleeper's mass exerts a downward force on the mattress, creating a depression in the mattress, since the downward force directly beneath the recliner is greater than similar forces elsewhere on the mattress, if such forces are present at all. Such a depression is of little consequence to a single sleeper. However, where there are dual sleepers on the same mattress, disparate downward forces are exerted on the surface of the mattress thereby causing disparate depressions, which often begin to overlap. The resulting surface of the mattress creates a tendency for the sleepers to roll toward the deeper of the depressions. Because the more massive sleeper causes deeper surface depressions, the less massive sleeper will generally be drawn toward the area that the more massive sleeper occupies such that unintended contact occurs. This prevents peaceful, undisturbed sleep.

It is therefore an object of this invention to maintain two separate depressions on the same mattress so that sleepers do not have a tendency to roll toward each other as they sleep.

It is an additional object of this invention to provide for a more level sleeping surface by reinforcing the inner perimeter of the sleeping surface.

It is a further object of this invention to increase the upward support of the mattress by providing a firm underlay directly beneath it.

It is a feature of this invention that it may be easily positioned or removed depending on the number of sleepers on the mattress.

SUMMARY OF INVENTION

The present invention takes the form of an article of manufacture for providing two sleepers on a dual occupancy bed with increased back support and for allowing each sleeper to remain undisturbed with respect to the downward force exerted on the mattress by the other sleeper. In its basic form, it comprises two planar members and a longitudinally extending, connecting element. This connecting element is positioned between and attached to the two planar members so that there exists a space between the two planar members at the region of connection. Upon its insertion directly beneath the mattress, the invention serves to prevent a surface depression in the mattress above the connecting element. Rather, on each side of the connecting element a single surface depression is created which is proportional to the mass of the sleeper. Because of the undisturbed surface area above the connecting member, neither sleeper has a tendency to roll toward the other.

Thus each may enjoy his sleep without experiencing any unintended contact with the other.

These and other objects, features and advantages of this invention will become more apparent when considered in connection with the accompanying drawings of a preferred embodiment therefor, in which drawings.

DETAILED DESCRIPTION OF PREFERRED EMBODIMENT

Figure 1:
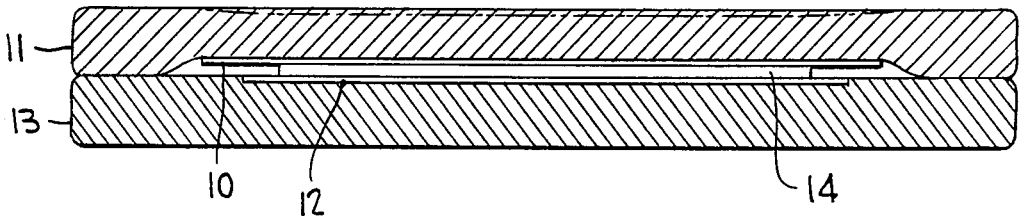
FIG. 1 is a side view of the backboard invention, illustrated in place between a mattress and a boxspring.

Referring to the drawings for a more particular description of the preferred embodiment of my invention, FIG. 1 shows a conventional mattress 11 overlying a conventional boxspring 13. Between them is shown the backboard which includes a first planar member or sheet 10 which in this preferred embodiment is constructed of a ¼ inch thick pliable material. Examples of such suitable materials are aspenite and plywood. Underlying it is a second planar member 12 which has smaller surface area than member 10 but is of the same thickness and manufactured from similar material. Positioned directly between and attached to the two planar members is a connecting element 14 which spaces the two planar members at the region of connection. Connecting element 14 is derived from a hard wood (such as oak or maple) and extends 48 inches in length when used in conjunction with a conventional double bed.

Figure 2:
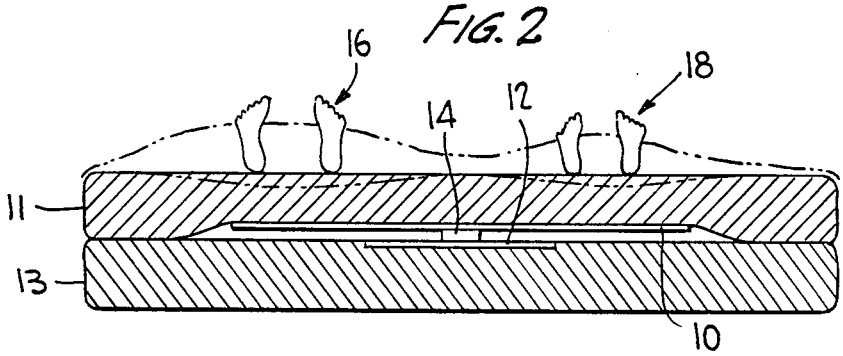
FIG. 2 is an end view of the embodiment of FIG. 1.

FIG. 2 shows the invention in the same preferred embodiment such that the connecting member 14 is centered between the two planar members 10 and 12 so as to bisect them along their lengths. The cross-section of the connecting element is rectangular, having dimensions 1 inch by 3 inches.

Figure 3:
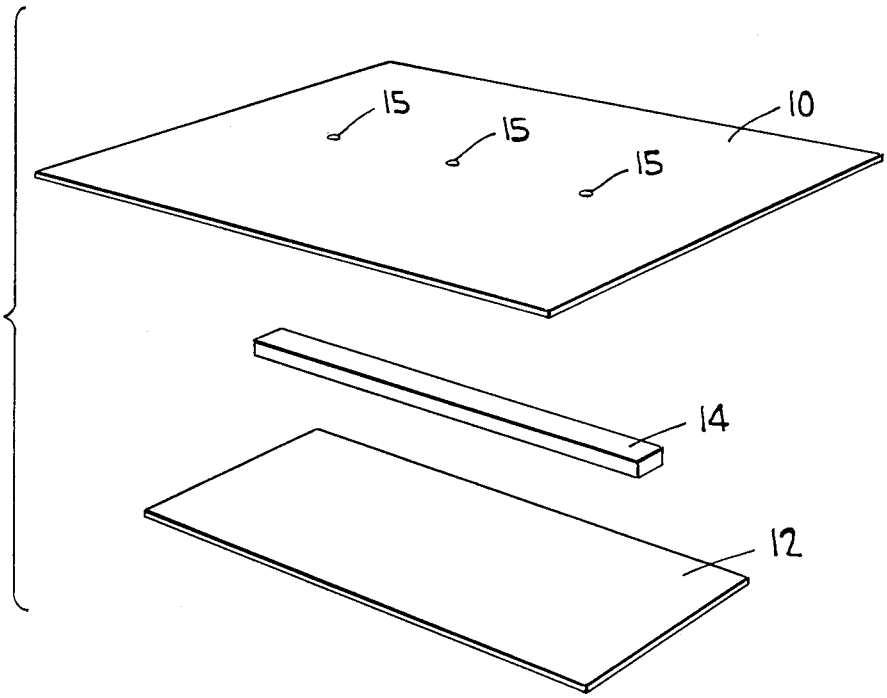
FIG. 3 is an exploded perspective view of the backboard according to the invention.

FIG. 3 shows the same backboard such that the sheet 10 is rectangular in plan view and possesses the dimensions 65 inches by 22 inches. The sheet 12 is also rectangular in plan view and its dimensions are 55 inches by 16 inches.

Attachment of the three elements may be achieved by a plurality of connectors 15 spaced along the connecting member and extending through the first planar member 10, the connecting element 14, and the second planar member 12. Such connectors may be three T nuts and bolts. However, attachment may also be effected by a high bond adhesive and other acceptable methods.

Referring again to FIG. 2, the effect of two sleepers 16 and 18, one on each side the connecting element 14 is illustrated. Sleeper 16 is of greater mass than sleeper 18. Each exerts a downward force on the mattress 11, thereby creating his own distinct depression on the surface. While the depression created beneath the more massive sleeper 16 may be somewhat more extensive than that below the less massive sleeper 18, the connecting element 14 serves to maintain and support the mattress 11 in the area separating the two sleepers. In this manner the formation of a common depression between the two sleepers is prevented, and thus each sleeper may retain his position on the common mattress substantially unaffected by the depression created by the other sleeper. At the same time, the first planar member 10 flexes slightly when the downward forces are applied thereby providing support to the mattress 11 which allows for a more level sleeping surface.

While my invention has been described herein in conjunction with a preferred embodiment thereof, which I presently deem to be the best mode, it will be apparent to those skilled in the art that there are many other embodiments through which the invention can be effected. I wish to protect these other obvious alternatives and modifications of my invention by my present application, which is to be limited only by the scope of the following appended claims, including the equivalents thereof.

I claim and desire to secure by Letters Patent of the United States:

1. A bedboard assembly particularly adapted for use with dual occupancy bed having a mattress, comprising a first bedboard having longitudinal and transverse dimensions and adapted to underlie the mattress of said bed and provide support to occupants thereto, a second bedboard having longitudinal and transverse dimensions and underlying said first bedboard, and a unitary horizontally elongated connecting element substantially narrower than either the first or second bedboards positioned between and attached to said first and second bedboards and extending a substantial portion of the longitudinal dimensions of said first and second bedboards and spacing said bedboards at the region of connection, so that the effect of disparate downward forces exerted on the mattress creates depressions in said mattress on each side of said longitudinally extending connecting element rather than above said element.

2. A bedboard assembly as recited in claim 1, wherein said connecting element bisects said first bedboard and said second bedboard along their longitudinal dimensions.

3. A bedboard assembly as recited in claim 2, wherein said connecting element is rectangular in plan view.

4. A bedboard assembly as recited in claim 1, wherein the longitudinal and transverse dimensions of said first bedboard exceed the corresponding dimensions of said second bedboard.

5. A bedboard assembly as recited in claim 4, wherein said first and second bedboards are rectangular in plane view.

6. A bedboard assembly as recited in claim 1, wherein said first and second bedboards are attached to said connecting element by a plurality of connectors spaced along said connecting member and extending through said first bedboard, said connecting element and said second bedboard.

7. A bedboard assembly as recited in claim 1, wherein the first and second bedboards are attached to the connecting element by a high bond adhesive.

* * * * *